United States Patent [19]

Shigemizu

[11] Patent Number: 5,044,568

[45] Date of Patent: Sep. 3, 1991

[54] HAND CRUSHER WITH ROTATABLY MOUNTED HANDLE

[75] Inventor: Akihiko Shigemizu, Tokyo, Japan

[73] Assignee: Takachiho Kogyo Yuugen Kaisha, Tokyo, Japan

[21] Appl. No.: 570,088

[22] Filed: Aug. 20, 1990

[51] Int. Cl.[5] ..... B02C 1/08

[52] U.S. Cl. ..... 241/169; 125/36; 173/37; 173/169; 173/170; 225/105; 241/266

[58] Field of Search ..... 241/168, 169, 264, 266; 173/168, 169, 170, 37; 125/230.1, 36, 23.02, 40, 41, 42, 43; 225/103, 104, 105

[56] References Cited

U.S. PATENT DOCUMENTS

| | | | |
|---|---|---|---|
| 1,847,136 | 3/1932 | Rauberstrauch | 125/23.01 X |
| 2,161,062 | 6/1939 | Killgore | 125/40 X |
| 3,060,894 | 10/1962 | Dean, Jr. et al. | 173/170 X |
| 3,241,622 | 3/1966 | Ottosson et al. | 173/170 X |
| 4,196,862 | 4/1980 | Tagawa | 241/266 |
| 4,512,524 | 4/1985 | Shigemizu | 241/266 X |
| 4,548,279 | 10/1985 | Zaruba | 173/170 |
| 4,838,493 | 6/1989 | LaBounty | 225/103 X |
| 4,890,798 | 1/1990 | Tagawa et al. | 241/266 |
| 4,934,616 | 6/1990 | Zepf | 241/266 |
| 4,951,886 | 8/1990 | Beito | 225/103 |

FOREIGN PATENT DOCUMENTS

| | | | |
|---|---|---|---|
| 490582 | 8/1938 | United Kingdom | 241/266 |

*Primary Examiner*—Mark Rosenbaum
*Assistant Examiner*—Frances Chin
*Attorney, Agent, or Firm*—Armstrong, Nikaido, Marmelstein, Kubovcik & Murray

[57] ABSTRACT

A hand crusher with a main body, which consists of a cylinder unit having a built-in oblong hydraulic cylinder and a parallel plate unit bonded on the periphery of said cylinder unit. Crushing arms are pivotally supported on the lower portion of the parallel plate unit, and the crushing are opened or closed in linkage with a piston rod, which extends from the hydraulic cylinder and makes reciprocal movement along the center line. Slide keys located at the tip of the piston rod engage in guide grooves on the parallel plate unit. A ring-like handle member is rotatably mounted on the rotating unit at the upper end of the cylinder unit, and a left grip and a right grip are connected on both ends of the handle member. On the inner periphery of the rotating unit of the handle member, balls are movably embedded at symmetrical positions, and catching recesses to catch the balls are furnished at every predetermined angle on the outer periphery of the rotating unit. Normally, the balls are caught in the catching recesses in a specific direction to engage the handle member and the main body together. When crushing arms are opened during operation, the left grip and the right grip are not moved. When the crushing arms engage on the object to be crushed from an oblique direction, balls are released from the recesses by reaction force, and only the main body is rotated. Both the left grip and the right grip are not swung around, and a single operator can operate the hand crusher by holding the left grip and the right grip at all times.

5 Claims, 9 Drawing Sheets

HAND CRUSHER WITH ROTATABLY MOUNTED HANDLE

BACKGROUND OF THE INVENTION

The present invention relates to a hand crusher to be used for dismembering concrete structures and the like.

In general, hydraulic crusher is used for crushing and dismembering concrete structures because high pressure is needed for the purpose, whereas a hand crusher is used when working space is small.

FIG. 8 shows the structure of a conventional type hand crusher, in which a pair of crushing arms 65 and 66 are pivotally supported at opposite positions by support pins 63 and 64 at both ends of a center link 62. The opposing crushing arms 65 and 66 are provided with toothed portions 65*a* and 66*a* on the lower parts and the end portions 65*b* and 66*b* on the upper ends. Further, the end portion 65*b* is connected to the connecting unit 69*a* of hydraulic cylinder 69 through a pin 67, and the end portion 66*b* is connected to the connecting unit 70*a* of a piston rod 70 of hydraulic cylinder 69 through a pin 68. On the left end and the right end of the connecting units 69*a* and 70*a*, grips 60 and 61 for hand gripping are furnished.

Therefore, when hydraulic pressure is applied during crushing operation, the piston rod 70 is extended from the hydraulic cylinder 69, widening the distance between the end portions 65*b* and 66*b* and closing the gap between the opposing toothed portions 65*a* and 66*a*. Thus, crushing operation is carried out.

In the conventional type equipment as described above, the operator grasps the grips 60 and 61 during crushing operation and lifts up heavy equipment, and the distance between the left and the right grips 60 and 61 is widened. Accordingly, it is necessary to move the positions of arms rapidly. Further, much force is required to maintain the equipment by unstable grips 60 and 61, which move to left and right, and wide working space is needed for the crushing operation.

Also, as shown in FIG. 9, when the object to be crushed 36 is caught between the toothed portions 65*a* and 66*a* of a pair of arms 65 and 66 from oblique direction (the direction A—A), rotation moment toward counterclockwise direction (the direction C) is generated as the engaging force of the toothed portions 65*a* and 66*a* is increase application of pressure, and pressure is applied on the object 36 from the direction perpendicular to it (the direction B—B). The toothed portions 65*a* and 66*a* finally crush the object 36 with big crushing force from the perpendicular direction (the direction . B—B), where rotation moment is turned to zero.

Therefore, when the object to be crushed 36 is not fixed on floor surface, the object is rotated clockwise (reverse to the direction C) and is crushed when the left and the right grips 60 and 61 are held firmly, while the object 36 is swung around and danger may occur as it hits the operator or other objects nearby.

When the object to be crushed 36 is fixed on floor surface, the toothed portions 65*a* and 66*a* are rotated by reaction force, and the left and the right grips 60 and 61 connected integrally with the toothed portions are swung around, and there is a possibility that the operator may be hit. In this way, in case of a conventional type hand crusher, when the object to be crushed 36 is caught from oblique direction, rotation moment is generated by reaction force, and the grips 60 and 61 or the object 36 are swung around. Thus, it is necessary for the operator to take special care not to catch the object from oblique direction, and this means heavy mental burden on the operator.

Therefore, in an unstable conventional type crusher with the left and the right grips moving to left and right during crushing operation, it is impossible to operate it by a single operator. There must be one operator each to hold the left and the right grips 60 and 61 respectively, and two operators are to be assigned on one crusher to carry out the crushing operation.

SUMMARY OF THE INVENTION

The present invention is to solve the problems of the conventional type equipment as described above.

It is an object of the present invention to offer a hand crusher provided with a rotataby mounted handle, comprising a cylinder unit having a built-in hydraulic cylinder in longitudinal direction on a center line, along which a pair of opposing crushing arms are opened or closed, and a parallel plate unit bonded on the periphery thereof, characterized in that crushing arms are pivotally supported at the lower portion of the parallel plate unit, that the crushing arms are opened or closed in linkage with with the piston rod extending from hydraulic cylinder and making reciprocal movement on said center line, that the guide key on the tip of the piston rod is engaged in the guide groove of the parallel plate unit, that a ring-like handle member is movably mounted on the rotating part on the top of the cylinder unit, that a left grip and a right grip are connected straightly on both ends of the handle member, that the left and the right grips protrude toward said center line at opposite positions, and that the equipment is long in longitudinal direction, is compact in design and is well balanced to left and right at opposing positions.

Another object of the invention is to offer a hand crusher provided with a rotatably mounted handle, having such structure that the left and the right grips are not moved during operation in linkage with the crushing arms, characterized in that free-moving balls are embedded at the opposing positions of the left and the right grips on inner periphery of the rotating part of said ring-like handle member, said balls being pushed by a force toward the rotating part by spring, that a recess to receive said balls is furnished on outer periphery of the rotating part of the cylinder unit, receiving said balls at each rotating angle, that said balls are received in said recesses when hand crusher is handled in ordinary manner, that the handle member and the main body are engaged together, and that the main body has such structure that it useless movement in relation to the handle is prevented.

Yet another object of the invention is to offer a hand crusher provided with a rotatably mounted handle, characterized in that the handle and the main body are disengaged when the rotation moment generated during the oblique engagement of crushing arms on the object to be crushed exceeds the fixing capacity of the balls on said rotating part, that only the main body is rotated and the left and the right grips held by the operator are not swung around, and that the operation can safely apply the crushing arms on the object to be crushed at any angle.

Another object of the present invention is to offer a hand crusher provided with a rotatably mounted handle, characterized in that the fixing capacity of the balls on the rotating part is freely adjustable by spring, and that the safe and efficient crushing operation can be carried out by adapting the fixing capacity to the physical strength of the operator and the available working space.

Still another object of this invention is to offer a hand crusher provided with a rotatably mounted handle, characterized in that a sling is furnished at the center on the top of the main body to hang the hand crusher vertically, or the main body is laid at horizontal position and a sling is furnished at the center of gravity to hang the hand crusher horizontally, that said sling receives the weight of the equipment so that a single operator can crush the object such as foundation member or wall member by operating the equipment with both hands, and that the operator may not be physically exhausted after long-time operation.

The other objects and features of the invention will be more clearly understood by the following detailed description on the embodiments in connection with the attached drawings.

DETAILED DESCRIPTION OF THE PREFERRED EMBODIMENTS

Figure 1:
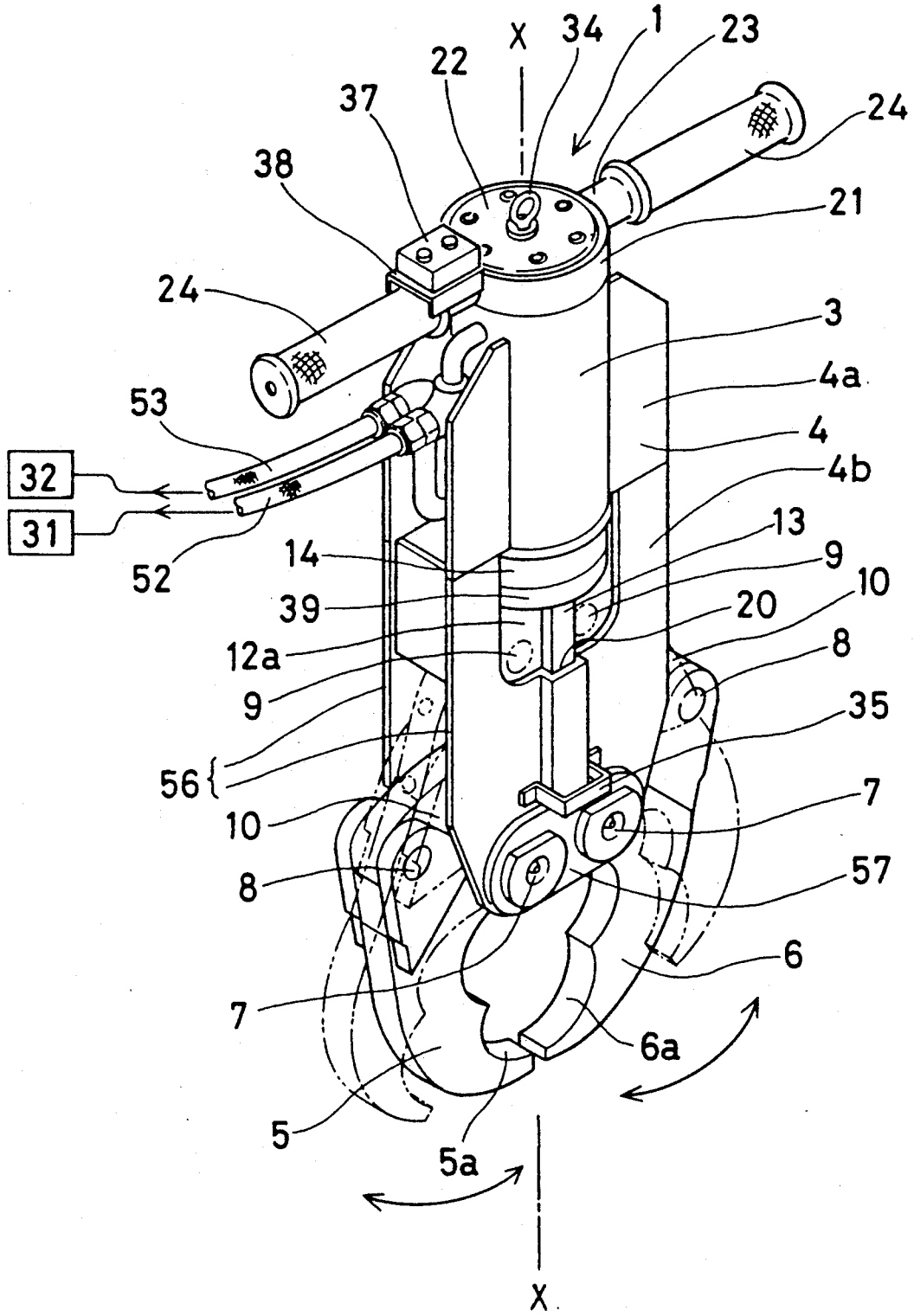
FIG. 1 is a perspective view of an embodiment of the hand crusher according to the present invention, showing the toothed portions of the crushing arms in closed state by solid lines and in opened state by broken lines.

In the following, description is given on the preferred embodiments of the invention in connection with the drawings, whereas the scope of the invention will not be limited by such embodiments.

The line X—X is an engagement center line, on which the toothed portions 5*a* and 6*a* of a pair of symmetrical crushing arms 5 and 6 of the hand crusher of this invention engage with other. The main body 1 of the hand crusher basically consists of a cylinder unit 3 containing a built-in hydraulic cylinder in longitudinal direction and a parallel plate unit 4 bonded on the periphery of said cylinder unit 3, centering on said the line X—X. The parallel plate unit 4 comprises two plates bonded in parallel on the periphery of the cylinder unit 3. In order to simplify the incorporation of a piston rod 12 as described later in this embodiment, the parallel plate unit is divided into an upper portion 4*a* and a lower portion 4*b* below the cylinder unit 3. After the piston rod 12 is assembled, they are joined together to form an integral equipment. It is also possible to design the parallel plate unit 4 in an integral structure without dividing it into the upper portion 4*a* and the lower portion 4*b*, and the two-part structure in this embodiment does not limit the scope of the present invention.

Figure 2:
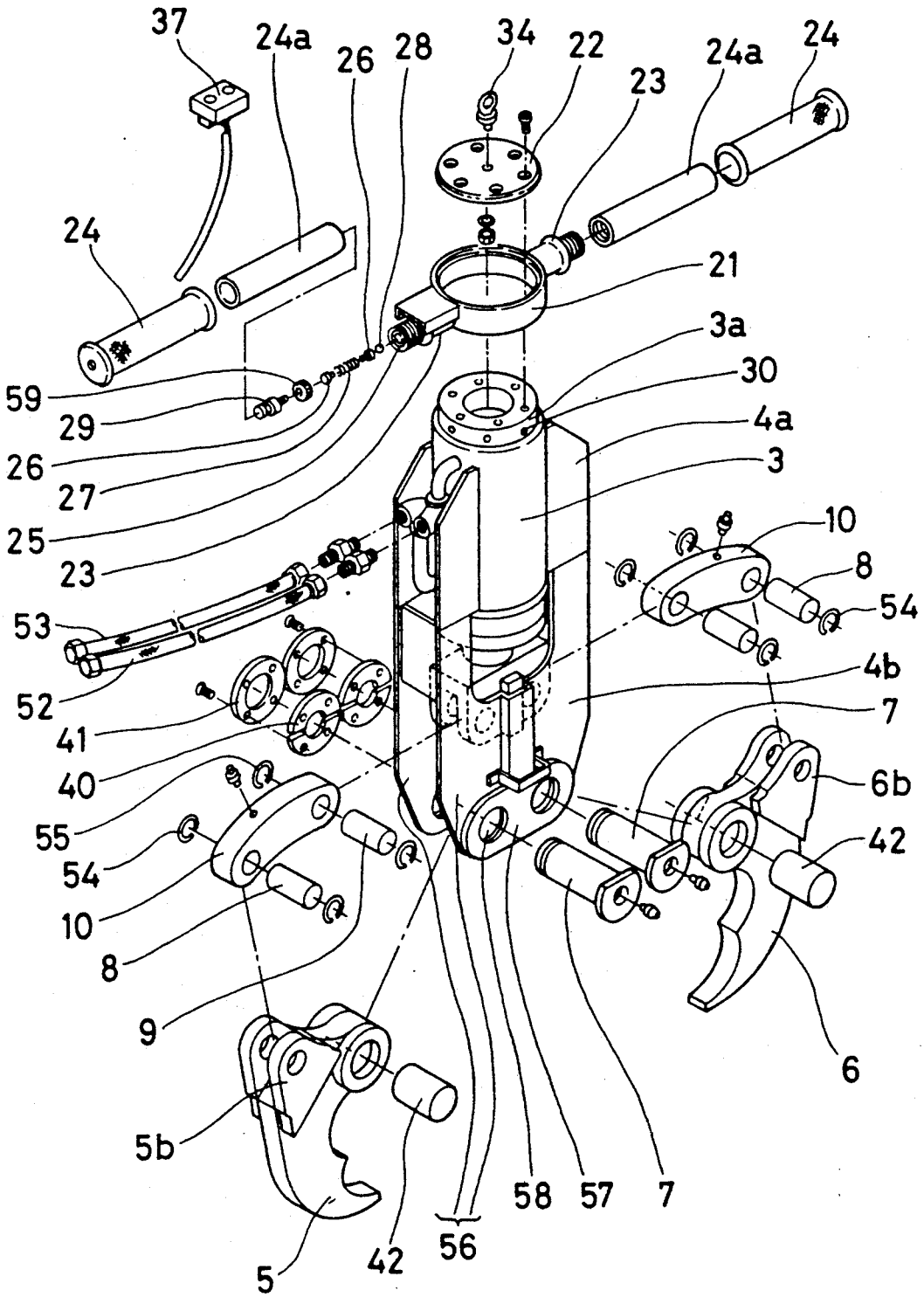
FIG. 2 is an exploded view, showing the entire structure of the hand crusher of FIG. 1.
Figure 3:
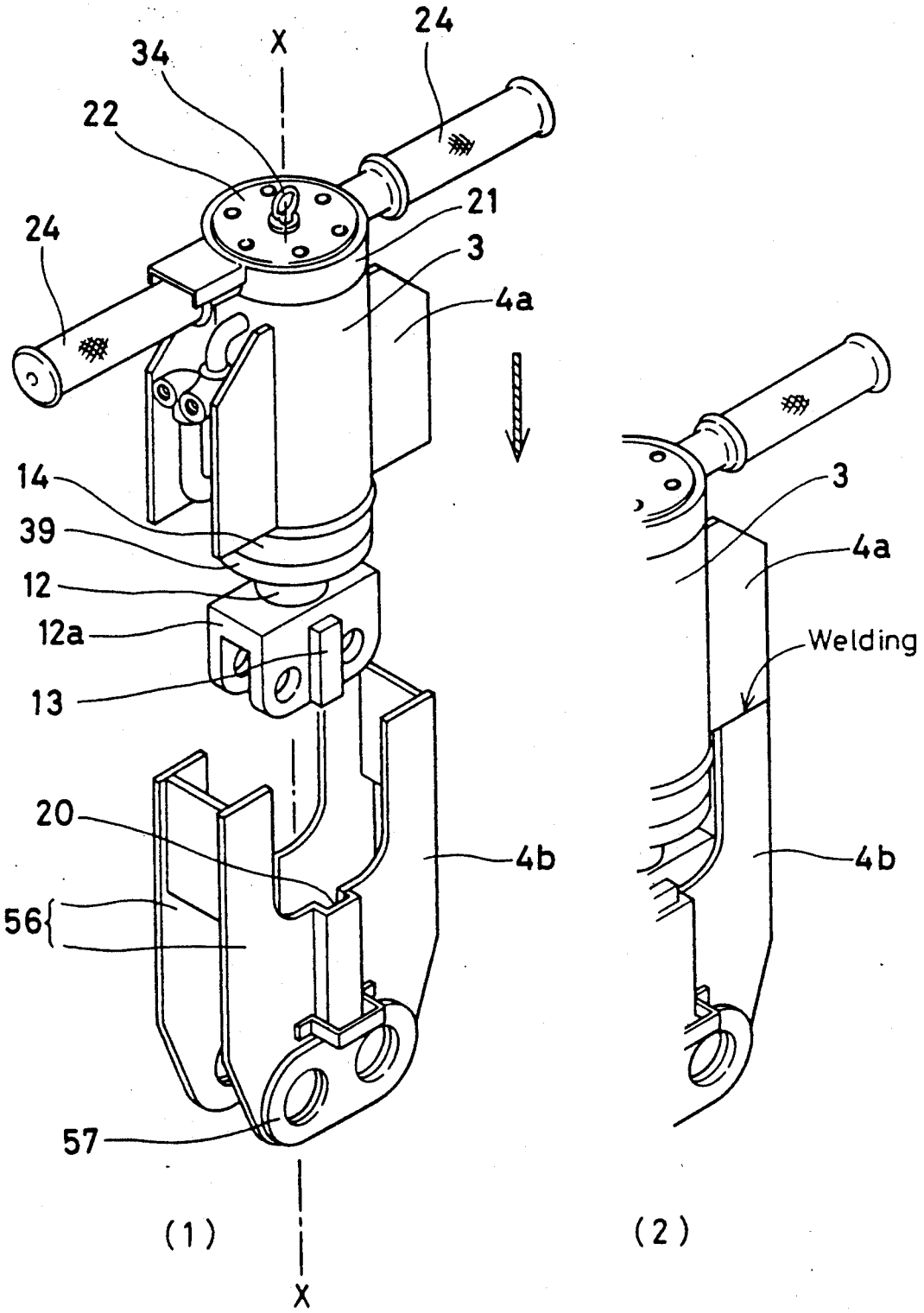
FIG. 3 is a partial perspective view of the parallel plate unit divided into upper and lower portions, showing relative relationship of each part when they are assembled into an integrity, and (1) represents the condition before assembling and (2) the condition after assembling.
Figure 4:
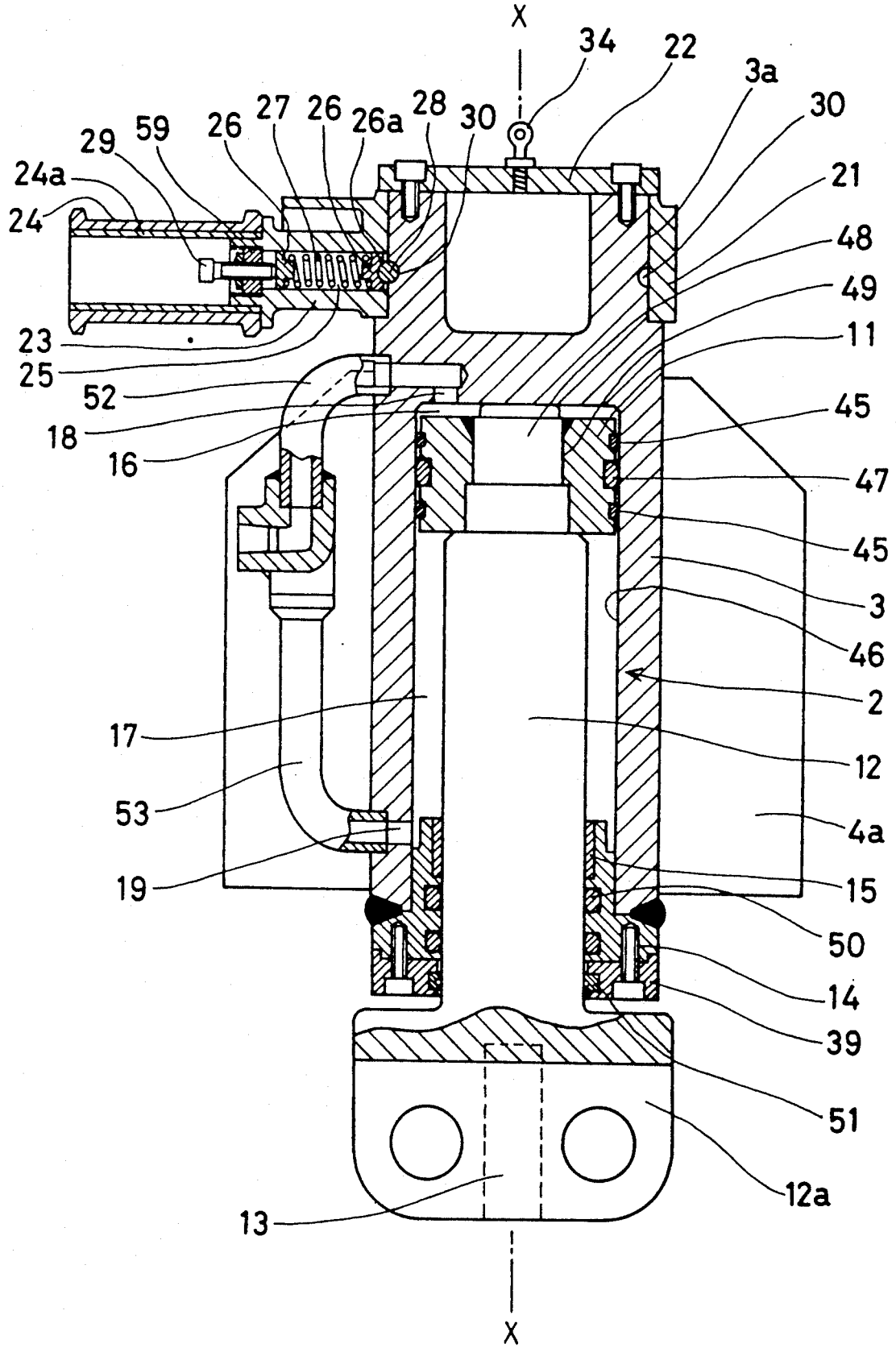
FIG. 4 is a partial sectional view of the upper portion before assembling of FIG. 3 (1)

On the lower end of the lower portion 4*b* of the parallel plate unit 4, a pair of pivot pins 7 and 7 are furnished in parallel. Placed inside the parallel plates 56 and 56, said crushing arms 5 and 6 are rotatably supported on the pivot pins 7 and 7 at symmetrical positions. Split washers 40, lock washers 41 and support bushes are furnished for fixing the pivot pins 7 (FIG. 2).

Piston 11 is inserted into the upper end 48 of the piston rod 12 and they are welded together not to be separated from each other. This welding eliminates oil leakage through the inserted portion 49. On outer periphery of the piston 11, rings 45 and 45 are shrink-fitted and are smoothly slided over the inner periphery 46 of hydraulic cylinder 2. 47 is a sealing member.

The hydraulic cylinder 2 is sealed by an end cover 14 welded on lower end of the cylinder unit 3. The piston rod 12 is guided by a bush 15 furnished on the end cover 14 and slides along the line X—X. To the lower end of the end cover 14, a set plate 39 is connected. Sealing members 50 and 51 are inserted into the end cover 14 and the set plate 39 respectively, sealing the sliding surface. Rod lower end 12*a* of the piston rod 12 is formed in U-shape, protruding downward from the set plate 39, and moves up and down between the parallel plates of the lower portion 4*b*. On both sides of the rod lower end 12*a*, slide keys 13 and 13 are fixed in the direction of the line X—X. Said slide keys 13 and 13 slide along the guide grooves 20 and 20 furnished on both sides of the parallel plates 56 and 56 of the lower portion 4*b*. Accordingly, the piston rod 12 and the main body 1 are always rotated together through the slide key 13 and the guide groove 20, and they are not deviated from each other when rotated.

The hydraulic cylinder 2 is separated into the operating cylinder 16 and the return cylinder 17 by the piston 11, which slides over inner periphery in oil-tight manner. On the cylinder unit 3, an oil port 18 communicating with the operating cylinder 16 and an oil port 19 communicating with the return cylinder 17 are furnished. Further, the oil port 18 is communicating with an external hydraulic pressure source 31 through an oil pipe 52, and the oil port 19 is communicating with an external hydraulic pressure source 32 through an oil pipe 53. These oil pipes 52 and 53 are installed in compact manner between the parallel plates 56 and 56 of the upper portion 4*a*. To the oil ports 18 and 19, hydraulic pressure is supplied from hydraulic pressure sources 31 and 32 through an on/off control means such as a push-button switch 37. The piston rod 12 extended from hydraulic cylinder 2 makes reciprocating movement along the line x—X. When oil is fed to the operating cylinder 16, the piston rod moves forward, and when oil is fed to the return cylinder 17, it moves backward.

The crushing arms 5 and 6 are provided with the symmetrical toothed portions 5*a* and 6*a* at lower positions and with the symmetrical U-shaped ends 5b and 6b at upper positions. A pair of support pins 8 and 8 are inserted into the ends 5b and 6b and support a pair of symmetrical and rocking links 10 and 10 by placing one ends of a pair of the links into the U-shaped ends. 54 is a retaining ring to retain the ends of the support pins.

On the other hand, a pair of support pins 9 and 9 are placed into the lower ends 12a of the rod, which makes reciprocating movement along the line X—X, and the pins support said pair of links 10 and 10 by placing the other ends of the links inside the ends of U-shaped lower ends. 55 are the retaining rings to retain the support pins 9. Thus, the rod lower end 12a is connected with the ends 5b and 6b of the symmetrical crushing arms through the links 10 and 10. When the piston rod advances, the crushing arms 5 and 6 are swung at symmetrical positions, close the toothed portions 5a and 6a, and crushing operation is carried out. On the contrary, when piston rod 12 moves back, the toothed portions 5a and 6a are opened.

The crushing arms 5 and 6 are held inside the parallel plates 56 and 56 of the lower portion 4b of the parallel plate unit 4, while elliptical side members 57 and 57 are furnished on external surfaces of the parallel plates 56 and 56. The side members 57 and 57 are provided with holes 58 and 58 for mounting a pair of opposing support pins 7 and 7. Because the side members 57 and 57 are protruding under the guide grooves 20 and 20 furnished on both sides of the lower portion 4b, it touches the slide keys 13 and 13 fixed on the rod lower end 12a when the piston rod goes down too far, thus preventing the excessive movement of the piston rod 12.

On the upper end of the cylinder unit 3 of the main body 1, the rotating unit 3a is furnished concentrically with the line X—X at the center. On the rotating unit 3a, a ring-like handle member 21 is rotatably mounted, and a stop cover 22 is fastened on it.

On both ends of the handle member 21, a pair of left and right projections 23 and 23 are furnished in the direction perpendicular to the line X—X, and the holes 25 and 25 are bored at the center of the projections 23 and 23. Outer periphery of the tips of the projections 23 and 23 are threaded, and the left and the right holders 24a and 24a are screwed on them. Further, the left and the right grips 24 and 24 are engaged with outer periphery of the holders 24a and 24a. It is desirable that the left and the right grips 24 and 24 are protruding at such positions that one operator can hold them with both hands. Thus, when the crushing arms 5 and 6 are opened or closed during operation, the left and the right grips 24 and 24 are not moved in linkage, and the left and the right grips 24 and 24 can be held by both hands during operation.

Two opposing spring holders 26 and 26 are inserted into the holes 25 and 25 with a spring 27 in each of them. On inner end of the spring holder 26 closer to the rotating unit 3a, a recess 26a is furnished to hold ball 28, and said ball 28 is pressed on outer periphery of the rotating unit of the cylinder unit 3. On inner periphery of the projection 23, a mounting fixture 59 is screwed on. On the other hand, outer end of the spring holder 26 distant from the rotating unit 3a touches the tip of the push bolt 29, which is movably screwed on the mounting fixture 59. The push bolt 29 is to adjust the force on the ball 28 by compressing the spring 27 through the holder 26. 38 is a bracket for the handle member 21, and a pushbutton switch 37 is furnished on it.

Figure 5:
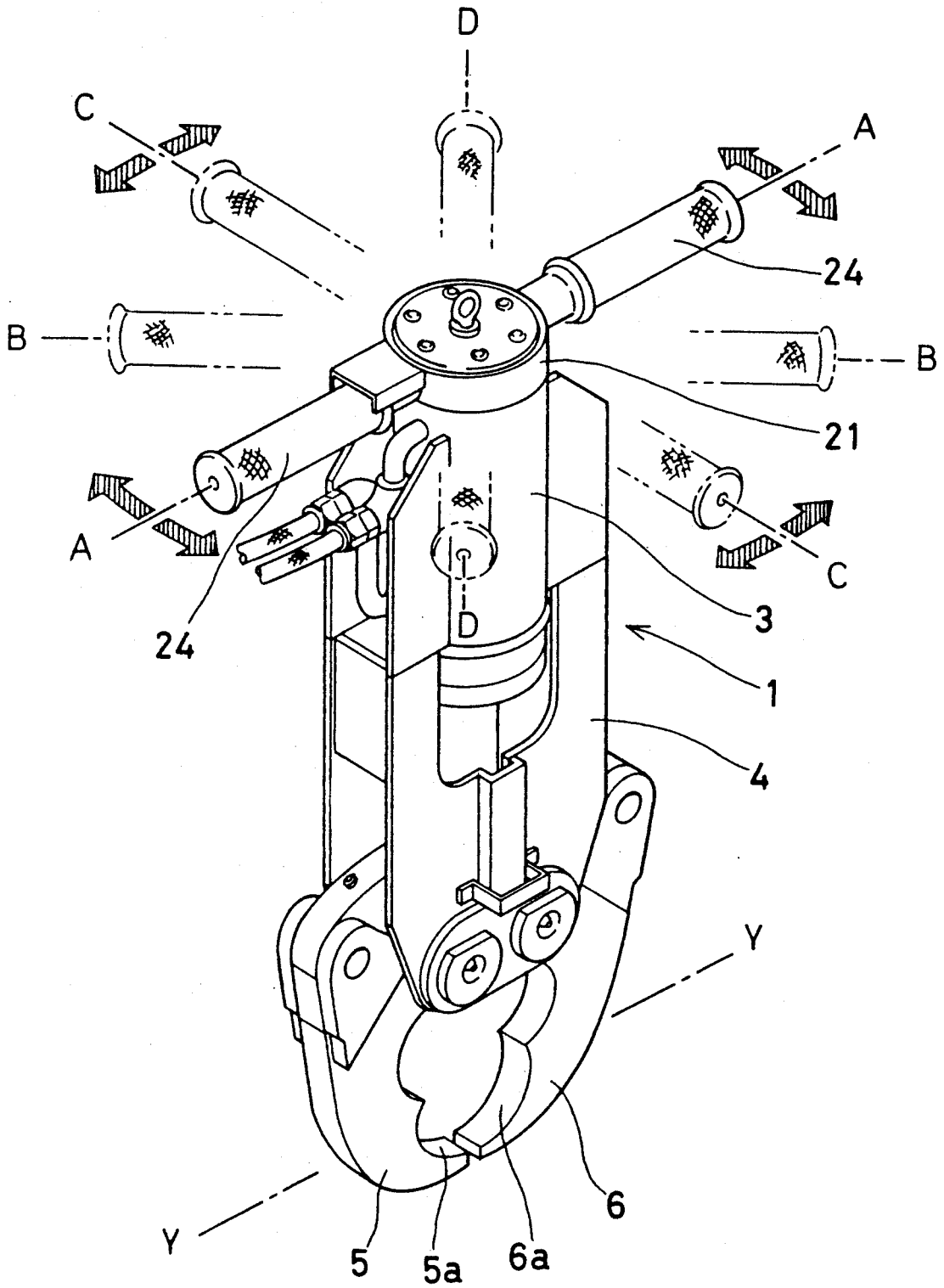
FIG. 5 is a drawing to explain the relative relationship between the direction of the left and the right grips and the crushing direction of the crushing arms when balls are caught in the recesses furnished at every 45 degrees on the rotating part of the hand crusher of the present invention.

On the other hand, on outer periphery of the rotating unit 3a, catching recesses 30 to catch and hold said balls 28 are provided at every 45 degrees on 8 points with reference to the crushing direction of a pair of crushing arms 5 and 6. Therefore, a pair of balls 28 normally embedded movably at symmetrical positions on inner periphery of the handle member 21 protrude toward a pair of the catching recesses 30 and 30, which are furnished in the crushing direction on outer periphery of the rotating unit 3a (the direction A—A in parallel to the direction Y—Y in FIG. 5). When the direction of the left and the right grips 24 and 24 is aligned with the direction A—A, the handle member 21 and the main body 1 are engaged together through the balls 28. When necessary, it is possible to fix the handle member 21 and the main body 1 together through the balls 28 in each of three different directions in addition to the crushing direction (direction A A): A): 45° direction (direction B—B), 90° direction (direction C—C), and 135° direction (direction D—D).

Figure 9:
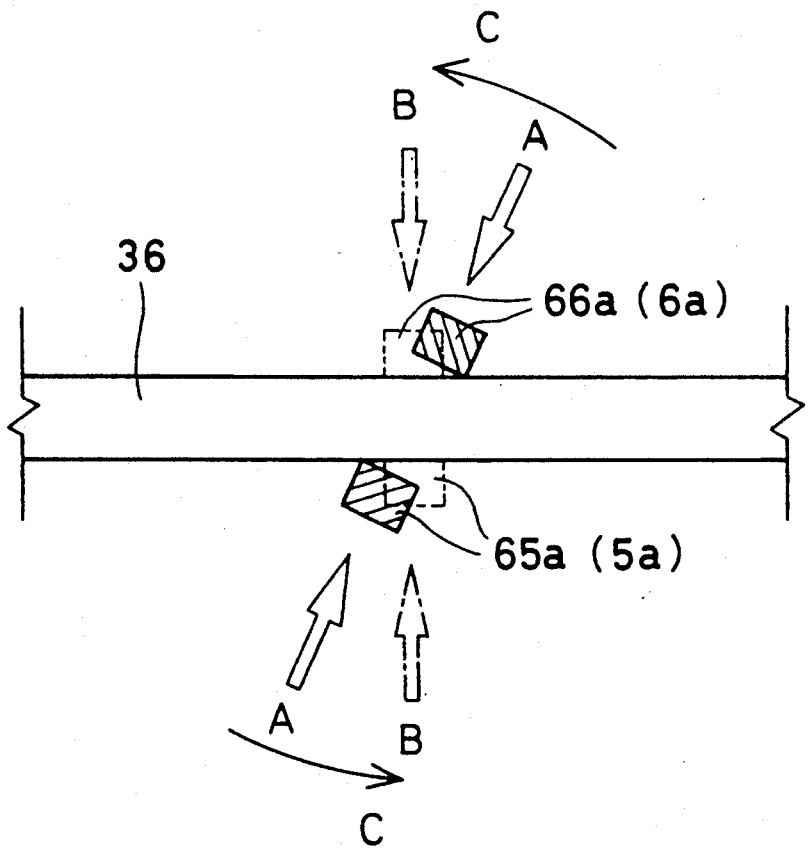
FIG. 9 is to explain the rotation moment generated between the crushing arms and the object to be crushed when the object is caught by the crushing arms from oblique direction.

Thus, when the handle member 21 and the main body 1 are fixed together in one of said 4 directions, the balls 28 are pushed into the catching recessed 30 by the force of the spring 27 in relation to angular moment generated simply from the weight of main body 1 or to the rotation moment of the crushing arms 5 and 6 generated from the mild crushing operation. The handle member 21 and the main body 1 are not disengaged, and said rotation moment is transmitted to the left and the right grips 24 and 24 from the crushing arms 5 and 6. Accordingly, the operator can stably operate the main body 1 by holding the grips 24 and 24 firmly by both hands, and the object 36 can be crushed by the crushing arms 5 and 6. However, when the object 36 is caught from oblique direction during crushing (FIG. 9), the toothed portions 5a and 6a and the main body 1 holding them are rotated by reaction force when pressure is applied. When rotation moment of the main body 1 exceeds the fixing capacity of the balls 28, the balls 28 come out of the catching recesses 30 against the resilient force of the spring 27. Thus, the ring member 21 and the main body 1 are disengaged. Only the main body 1 is rotated on the rotating unit 3a, and the handle member 21 is not rotated. Accordingly, the operator is not swung around even when he holds the grips 24 and 24 firmly by both hands. The engagement between the ring member 21 and the main body 1 is limited by the fixing capacity of the balls 28. Because the fixing capacity of the balls 28 can be adjusted by changing the force of the spring 27 through the insertion or withdrawal of the push bolt 29, it is preferable to adjust it to the fixing capacity suitable for physical strength of the operator.

Next, description is given on the case where the hand crusher of this invention is hung in vertical or horizontal position and the object 36 such as foundation member 43 or wall member 44 is crushed by a single operator.

Figure 6:
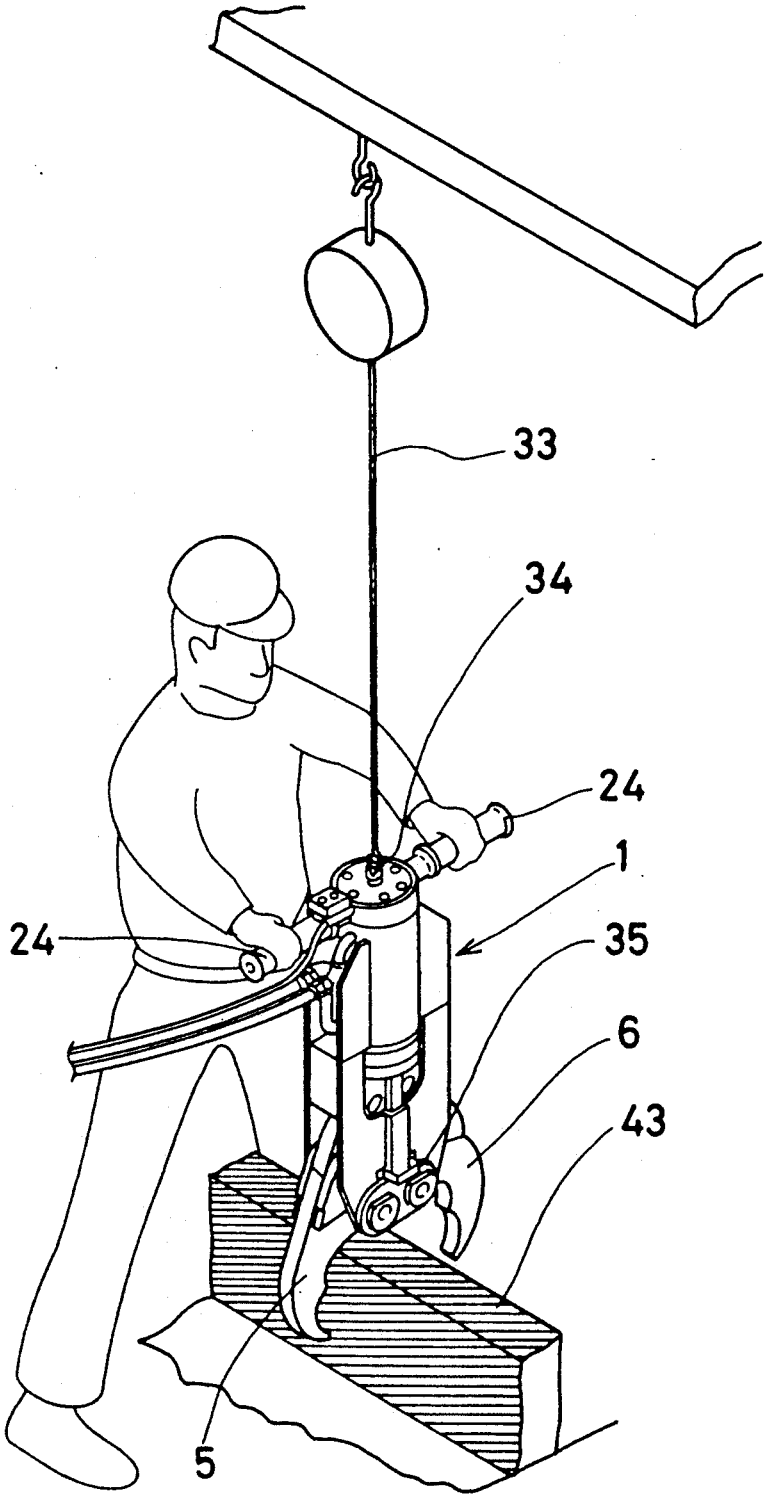
FIG. 6 is a drawing to illustrate the working condition by hanging the hand crusher vertically to crush an object such as foundation member.
Figure 7:
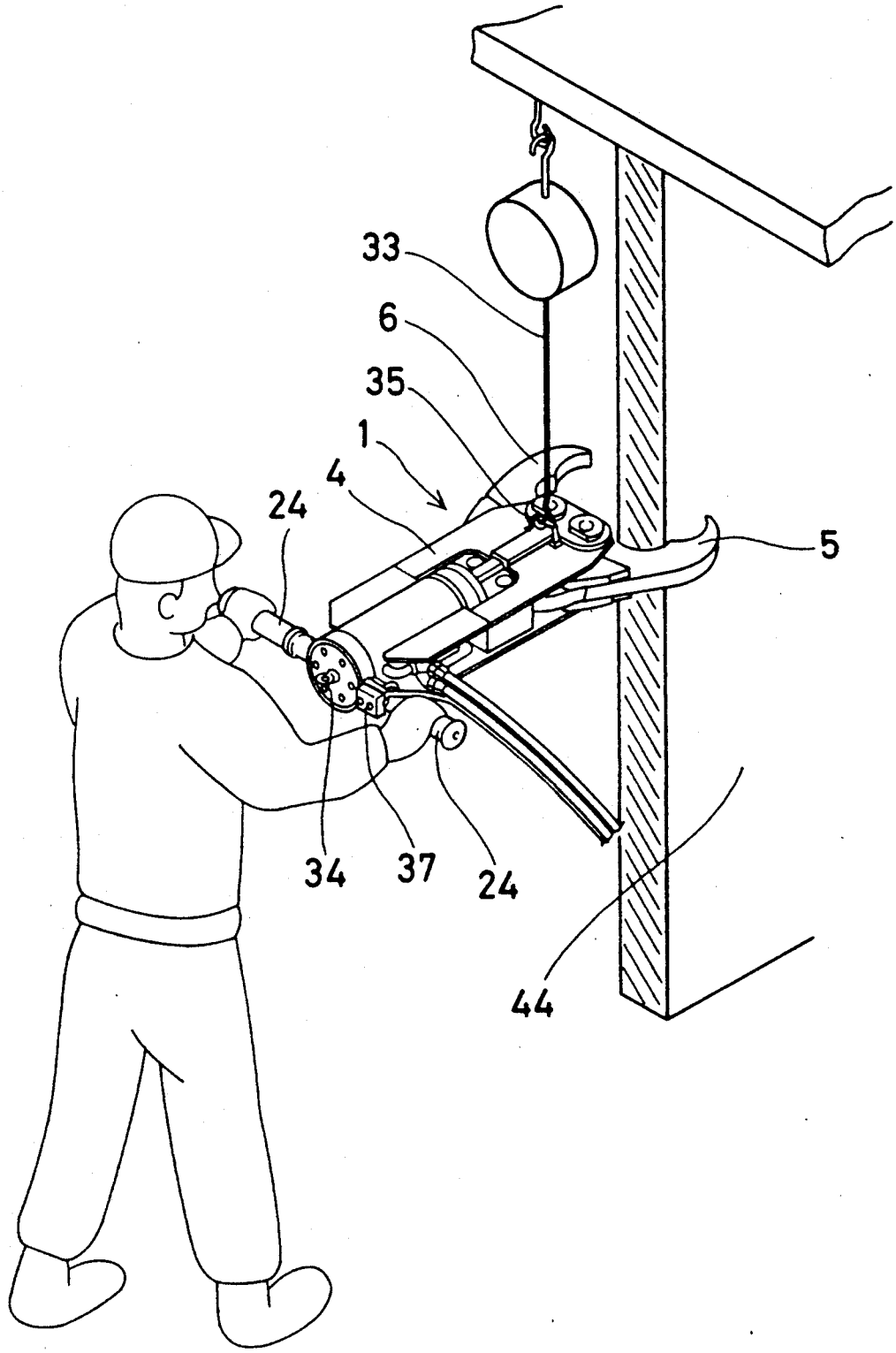
FIG. 7 is a drawing to illustrate the working condition by hanging the hand crusher in horizontal position to crush an object such as wall member.
Figure 8:
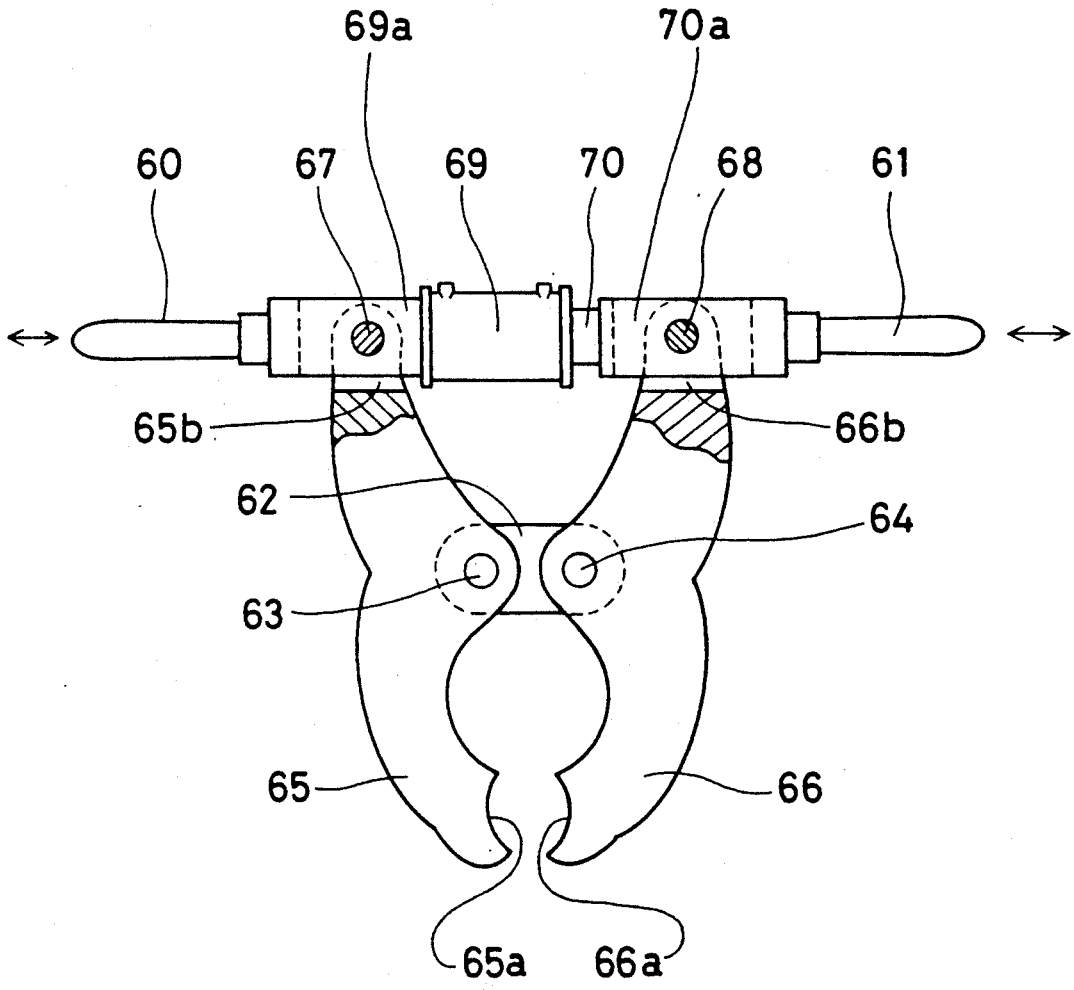
FIG. 8 is a front sectional view of a conventional type hand crusher.

FIG. 6 shows an operating procedure to crush an object 36 such as foundation member 43. A sling 34 is screwed at the center of the cover 22 of the cylinder unit 3. Main body 1 is hung vertically from ceiling by length-adjustable wire 33. Crushing arms 5 and 6 are engaged on the object 36 from above to crush. Because the weight of the main body 1 is applied on the sling 34, and the operator can hold the left and the right grips 24 and 24 firmly, crushing operation can be carried out for long time by a single operator. Because it is hung by wire 33, the crusher can be easily moved or rotated to some extent, and this extensively improved the working efficiency. FIG. 7 shows the operating procedure to crush an object 36 such as wall member 44. A sling 35 is attached on the center of gravity of the parallel plate unit 4 held at the horizontal position, and main body 1 is hung horizontally from ceiling by length-adjustable wire 33. The crushing arms 5 and 6, opening or closing in horizontal direction, are engaged on the object 36 from horizontal direction to crush. Similarly to the procedure as described above, the crusher can be moved or rotated easily to some extent. A single operator can perform the crushing operation for long time, and this extensively increases the working efficiency.

The usefulness of the present invention can be summarized as follows:

(i) The main body 1 is longer in longitudinal direction to the engagement center line of the crushing arms 5 and 6, and good balance is maintained on left and right at symmetrical positions and the equipment is designed in compact form. Thus, crushing operation can be carried out in smaller working space by a single operator, firmly holding both grips.

(ii) Because the left and the right grips are not moved when the crushing arms are opened or closed during operation, the operator can hold the grips and operate the crushing arms in stable manner.

(iii) Because the handle member and the main body 1 are fixed together and are not rotated normally, the main body can be moved freely in any direction, and the crushing arms can be easily and firmly engaged on the object from the most effective direction.

(iv) When crushing arms are engaged on the object from oblique direction, the main body is rotated together with the crushing arms by reaction force. When rotation moment exceeds the fixing capacity of the balls on the rotating unit, the handle member and the main body are disengaged, and only the main body is rotated. Because the handle member is not rotated, the operator is not swung around together with the grips. Accordingly, crushing arms can be engaged from any direction on the object, and this increases the working efficiency.

(v) Because the fixing capacity of the balls on the rotating unit is freely adjustable, the crushing operation can be carried out safely and efficiently by adequately adjusting it to physical strength of the operator and to the working space.

(vi) Because the weight of main body is applied on the sling and crushing operation can be carried out easily only by operating both grips, it is possible to crush an object such as foundation member or wall member by one operator, and the operator is not physically exhausted after long-time operation.

In the above, the present invention has been described by the embodiments as given in the drawings, while the invention is not limited to such description, and it is defined by the claims as set forth hereinunder.

I claim:

1. A hand crusher with rotatably mounted handle, comprising a main body, which consists of a cylinder unit having a built-in hydraulic cylinder in longitudinal direction along an engagement center line of a pair of crushing arms, being opened or closed at symmetrical positions and of a parallel plate unit bonded on said cylinder unit, wherein said crushing arms are pivotally supported at a lower portion of the parallel plate unit, said crushing arms are opened or closed in linkage with a piston rod which is extended from said hydraulic cylinder and makes reciprocal movement along said center line, slide keys furnished at a tip of said piston rod are engaged in guide grooves on the parallel plate unit, a handle member having a left grip and a right grip is rotatably mounted on a rotating unit at an upper end of the cylinder unit, the left grip and the right grip are connected straightly on both ends of the handle member and protrude at symmetrical positions to said center line, and the main body is designed in oblong and compact form and is well balanced on both sides at symmetrical positions.

2. A hand crusher with rotatably mounted handle according to claim 1, wherein balls are movably furnished on inner periphery of the handle member at the positions facing the left grip and the right grip, said balls being pushed by a spring in the direction toward the rotating unit, catching recesses are furnished to catch said balls at every predetermined angle on outer periphery of the rotating unit of the cylinder unit, said balls are caught in said catching recesses when the hand crusher is operated normally, and the handle member and the main body are engaged together to prevent the. useless rotation of the main body in relation to the handle member.

3. A hand crusher with rotatably mounted handle according to claim 2, wherein, when the crushing arms engage on an object to be crushed from an oblique direction, the handle member and the main body are disengaged if the rotation, moment exceeds a fixing capacity of the balls on said rotating unit, and only the main body is rotated and an operator holding the left grip and the right grip is not swung around.

4. A hand crusher with rotatably mounted handle according to claim 3, wherein the fixing capacity of the balls on rotating unit is freely adjustable through spring.

5. A hand crusher with rotatably mounted handle according to one of claims 1, 2, 3 or 4 wherein a sling is provided at the center on the top of the main body to hang the hand crusher vertically, or a sling is provided approximately at the center of gravity of the main body at horizontal position to hang the hand crusher at horizontal position, the weight of the main body is applied on said sling, and a single operator can operate it by both hands to crush an object such as foundation member or wall member.

* * * * *